US006821181B1

(12) United States Patent
Domingues

(10) Patent No.: US 6,821,181 B1
(45) Date of Patent: Nov. 23, 2004

(54) AMUSEMENT DEVICE WITH SPARKING MEANS

(76) Inventor: Francisco Bicalho Domingues, 423-427 W. 127th St., Third Floor, New York, NY (US) 10027

( * ) Notice: Subject to any disclaimer, the term of this patent is extended or adjusted under 35 U.S.C. 154(b) by 39 days.

(21) Appl. No.: 10/312,953

(22) PCT Filed: Aug. 3, 2000

(86) PCT No.: PCT/US00/21252

§ 371 (c)(1),
(2), (4) Date: Mar. 29, 2003

(87) PCT Pub. No.: WO02/11833

PCT Pub. Date: Feb. 14, 2002

(51) Int. Cl.[7] ..... A63H 33/38
(52) U.S. Cl. ..... 446/22; 446/462; 446/457; 446/437
(58) Field of Search ..... 446/462, 437, 446/22, 23, 463, 409, 438

(56) References Cited

U.S. PATENT DOCUMENTS

| | | | | | |
|---|---|---|---|---|---|
| 1,685,412 | A | * | 9/1928 | Arnold | 446/22 |
| 1,918,122 | A | * | 7/1933 | Naue | 446/23 |
| 2,386,745 | A | * | 10/1945 | Lee | 446/468 |
| 3,665,639 | A | * | 5/1972 | Knox | 446/489 |
| 4,286,806 | A | | 9/1981 | Bergstein | |
| 4,463,515 | A | * | 8/1984 | Barlow et al. | 446/409 |
| 4,556,396 | A | | 12/1985 | Kennedy | |
| 4,571,212 | A | | 2/1986 | Kakizaki | |
| 4,676,763 | A | * | 6/1987 | Saito et al. | 446/230 |
| 4,695,262 | A | | 9/1987 | Crosby et al. | |
| 4,836,823 | A | * | 6/1989 | Laven | 446/485 |
| 4,850,931 | A | | 7/1989 | Auer | |
| 5,019,009 | A | | 5/1991 | Chao-Chin | |
| 5,352,147 | A | * | 10/1994 | Nagel et al. | 446/409 |
| 5,391,102 | A | | 2/1995 | Bosch | |
| 5,460,560 | A | | 10/1995 | Liu | |
| 5,470,267 | A | | 11/1995 | Busam | |
| 5,499,940 | A | * | 3/1996 | Johnson et al. | 446/429 |
| 5,523,925 | A | | 6/1996 | Bare, IV | |
| 5,531,623 | A | | 7/1996 | Garner | |
| 5,643,036 | A | | 7/1997 | Liu | |
| 5,775,972 | A | * | 7/1998 | Siu | 446/468 |
| 5,785,576 | A | | 7/1998 | Belton | |

* cited by examiner

*Primary Examiner*—Derris H. Banks
*Assistant Examiner*—Urszula M Cegielnik
(74) *Attorney, Agent, or Firm*—Richard L. Strauss, Esq.

(57) ABSTRACT

An amusement device with sparking means comprises a central housing which encapsulates a power means. An axle support is located at a bottom portion of the housing, functioning to allow an axle to extend horizontally therethrough. A plurality of wheels are rigidly affixed to the axle and located at extreme ends of the axle. The axle is of a generally bent configuration, functioning to allow the amusement device to move across a surface in a wave-like pattern. A rudder member acting as front support means comes in contact with a flat surface upon which the amusement device is placed, and is rigidly affixed to a wind-up handle. The wind-up handle is rigidly connected to the power means located within the housing, functioning to allow a user to crank the handle to engage the power. A generally elliptical friction disc member is located at a position above the housing and positioned horizontally thereto. The friction disc member comprises a rotating arm, which is parallel to the friction disc. The rotating arm is secured in place by a central rotating arm support, and comprises a sparking agent extending downwardly therefrom. The sparking agent functions to come in contact with rotating friction disc to create a sparking effect when the amusement device is powered.

6 Claims, 4 Drawing Sheets

AMUSEMENT DEVICE WITH SPARKING MEANS

FIELD OF INVENTION

The present invention is a self-propelled toy, which, in the preferred mode, comprises a two wheeled wind-up mechanism which operates using a gear box, a rudder, a flint, and a striker element. When the toy is wound and released, the flint spins against the striker element, creating a sparking effect. The rudder, located below the gearbox, is rigidly affixed to the wind up mechanism. The rudder comes in contact with the surface upon which the item travels, and functions to steer the propelled item in a wave-like manner.

DESCRIPTION OF THE PRIOR ART

Many innovations for amusement devices with sparking means are provided in the prior art, described as follows. Although these inventions are suitable for the purposes they address, they differ from the present invention as contrasted herein. Following is a summary of patents most relevant to the invention at hand, including description of differences between features of the invention and those of the prior art.

1. U.S. Pat. No. 4,556,396, invented by Kennedy et al., entitled "Stunt-Performing Toy Vehicle". The patent to Kennedy et al. describes a miniature toy vehicle capable of performing rear wheelies, pinouts and other playful stunts, the vehicle including a chassis having rotatable front and rear wheel axles mounted thereon, a hollow body being supported on the chassis to simulate the appearance of an automobile. A flywheel motor is supported for rotation on the chassis within the body on a flywheel axle normal to the rear wheel axle. The flywheel axle is operatively coupled to the rear wheel axle whereby when the rear wheel axle is rotated, it causes the flywheel motor to spin and to store energy for propelling the vehicle in the forward direction. The relationship of the flywheel motor to the structure of the vehicle is such as to cause the vehicle to behave as a gyro exhibiting precessional motion which in combination with the concurrent forward motion makes it possible for the vehicle to perform stunts. The flywheel has a layer of abrasive material on its upper face. A flint is supported on a pivotable arm and is caused to apply a slight downward pressure on the abrasive material to generate sparks as the flywheel is rotated.

2. U.S. Pat. No. 5,391,102, invented by Bosch, entitled: "Sparking Toy Vehicle". The patent to Bosch describes a sparking toy vehicle for being supported on a play surface and includes a vehicle body, front and rear wheels rotatably mounted on the vehicle body and a spark generating mechanism mounted on the vehicle. The at least two wheels are mounted with respect to the body for movement between a first position in which the body is a first distance from the play surface when the wheels are in engagement with the play surface and a second position in which the body is a second distance from the play surface when the wheels are in engagement with the play surface. The spark generating mechanism is spaced from the play surface when the body is in the first position and is in contact with the play surface when the body is in the second position. When the vehicle body in the second position and the vehicle is moved across the play surface the spark generating mechanism is in rolling contact with the play surface and generates a spark.

3. U.S. Pat. No. 4,571,212, invented by Kakizaki, is: "Spark Emitting Fly Wheel Driven Vehicle". In the patent to Kakizaki, a toy vehicle is supported on one end by at least one wheel and on the other end by a fly wheel which is capable of being energized by pulling a gear rack across a pinion which is connected to the fly wheel. On one of the side surfaces of the fly wheel, a material is located which, when contacted by a flint, is capable of emitting sparks. A flint holding member is positioned adjacent to the fly wheel with a flint located on the flint holding member so as to contact the material on the side of the fly wheel. In conjunction with rotation of the fly wheel, sparks are emitted from contact of the flint with the material. Thus, as the car is propelled across a support surface by the fly wheel a trail of sparks are given off.

4. U.S. Pat. No. 4,850,931, invented by Auer, entitled: "Spin-Out Toy Vehicle". The patent to Auer describes a toy vehicle in which a flywheel motor assembly is operatively coupled to one set of wheels such that when the motor is revved up and the vehicle is released, it then advances on the ground in the forward direction, A set able distance counter assembly is operatively coupled to the other set of wheels to count the number of feet or other increment of distance traveled by the vehicle. Also includes is a braking mechanism provided with a normally-retracted brake shoe whose position is off center with respect to the longitudinal axis of the vehicle and a normally-retracted brake clutch adapted to engage a braking wheel in the flywheel motor assembly. The braking mechanism is responsive to the distance counter such that when a pre-set distance is traveled by the vehicle, the brake shoe is projected below the chassis to engage the ground and the brake clutch is then caused to engage the braking wheel to arrest the motor. As a consequence, the braked vehicle is caused to swerve from the forward direction, to skid and to spin out.

5. U.S. Pat. No. 5,460,560, invented by Liu entitled: "Sparking Toy Vehicle And Launcher Therefor". The patent to Liu describes a toy vehicle and a launching assembly for launching the vehicle. The vehicle includes a rotatable sparking mechanism and a drive gear for rotating the sparking mechanism. The launching assembly includes and inclined ramp for receiving the vehicle and a gear train having a drive gear extending upwardly through an aperture in the inclined ramp. The drive gear intermeshes with the vehicle drive gear when the vehicle is received on the ramp. The launching assembly further includes a plunger mounted for engagement with the rear of the vehicle when the vehicle in received on the ramp, and a spring for normally biasing the plunge to an extended position. The gear train is driven by a pivotable lever mounted on the shaft of an actuator gear. Pivoting of the lever rotates the drive gear thereby rotating the sparking mechanism to generate sparks. Pivoting of the lever also withdraws and releases the plunger mechanism to forcibly propel the vehicle off the launching assembly and across a supporting surface.

6. U.S. Pat. No. 5,470,267, invented by Busam, entitled: "Spark Producing Mechanism". The patent to Busam describers a spark producing mechanism for a toy and includes an at least partially transparent housing, a rotatable abrasive element in the housing and a motor for rotating the abrasive element. The mechanism further includes at least one flint element which is loosely captured in the housing so that it can contact and carom off the abrasive element to randomly produce sparks in the housing during rotation of the abrasive element.

7. U.S. Pat. No. 5,531,623, invented by Gamer, et al., entitled "Toy Welding Apparatus With Sparking Mechanism". The patent to Garner et al. describes a toy welding apparatus which includes a spin welding mechanism which is operative for welding thermoplastic articles together utilizing a rotating thermoplastic rod. The apparatus further includes a sparking mechanism for producing sparks during operation of the spin welding mechanism so that the operation of the welding apparatus realistically simulates that of an arch welding apparatus.

8. U.S. Pat. No. 4,286,806, invented by Bergstein entitled "Roller Skating Spark Generator". The patent to Bergstein describes a spark-generating mechanism for mounting on, and for use in combination with, a roller skate or roller skateboard. The mechanism includes a support bracket adapted to be attached to the skating device, to carry rotatably a grindstone wheel between two larger actuating wheels and to hold a spark producing element in resilient contact with the grindstone wheel. Positioned to be inoperative during normal skating, the spark-generating mechanism may be actuated at will by the skater's slightly backward tilting of the roller skating device while in motion.

9. U.S. Pat. No. 5,523,925, invented by Bare IV entitled "Light Emitting Device for Bicycle". The patent to Bare IV describes a light emitting device for bicycles which has a dynamo-like pinion arrangement. A spinner rotates an abrasive material across a flint, emitting sparks which illuminate a transparent or translucent vessel of the device. The device is mounted to one rear wheel strut of a bicycle frame and includes a mechanism which urges the spinner against the rear tire. A lock mechanism provides a second unengaged position for the device. A flint holder provides both a guide bore for the flint, and applies pressure behind the flint, thereby urging the flint against the abrasive material. This provides a non-electrical light source for bicycles in which sparks of intensity proportionate to the speed of cycling are created.

10. U.S. Pat. No. 4,695,262, invented by Crosby, et al., entitled "Toy Rotating Gear Accessory For Use With Gyroscopic Top". The patent to Crosby, et al., describes a toy rotating gear accessory which may be used in conjunction with a gyroscopic top. The accessory has a supporting body with a number of apertures passing through it. One or more circular gears may be removably attached to the supporting body by segmented flexible members located on the top surfaces of the gears. The flexible members may be inserted into or slid out of the apertures in the supporting body by simply bending the members. After the gears are attached to the supporting body, they are free to rotate with respect to the body. Protuberances located on the top surface of each gear help to reduce friction between the gears and the supporting body. Supports located on the bottom surface of the gears support the accessory on a horizontal surface. During play, a child may insert the rotating portion of a gyroscopic top into a cylindrical bore located on the upper surface of one of the gears. This causes the gear to rotate and the entire accessory to rotate about the center of the gear. The teeth of the rotating gear engage the teeth of adjacent gears causing all of the gears to rotate at the same time. The toy rotating gear accessory may be used with one or more gears.

The relevant prior art illustrates items such as: sparking toy cars or trucks; sparking items attachable to roller skates, skateboards and bicycles; sparking toy guns; sparking toy tools; and non-sparking toy vehicles propelled in a sliding or skidding fashion.

In contrast to the above, the present invention comprises a wheeled, wind-up mechanism using a gear box, rudder, flint, and striker element. When wound and released, the flint spins against the striker, creating a sparking effect, while the rudder functions to steer the item across a surface in a wave-like manner.

SUMMARY OF THE INVENTION

As noted, the present invention is a self-propelled toy, which, in the preferred mode, comprises a two wheeled wind-up mechanism which operates using a gear box, a rudder, a flint, and a striker element. When the toy is wound and released, the flint spins against the striker element, creating a sparking effect. The rudder, located below the gearbox, is rigidly affixed to the wind-up mechanism. The rudder comes in contact with the surface upon which the item travels, and functions to steer the propelled item in a wave-like manner.

According to the foregoing, it is an object of the present invention to provide an entertaining device which can be used by children and adults. It is a more particular object of the invention to provide an entertaining device which may be used at a party or other social setting. It is a further goal of the present invention to provide an amusement device that generates exciting illumination in the form of sparks. It is a goal of the invention to provide an amusement device that may be constructed in varying sizes. It is a further goal of the present invention to provide an entertaining device that may bear various colors and patterns thereupon. It is a further goal of the present invention to provide an amusement device that may bear indicia thereupon, such indicia relating to a previously determined them or style. It is a goal of the present invention to provide an amusement device that functions effectively without the usage of complex or expensive power means. It is a further goal of the present invention to provide an amusement device that is substantially lightweight and constructed of relatively inexpensive materials. Finally, it is an aim of the present invention to provide an entertaining device that may be manufactured with relative ease.

In total, the novel features considered characteristic for the invention are set forth in the claims. The invention itself both as to its construction and method of operation, will be best understood from the following description of the embodiments when read and understood in connection with the drawings provided.

DETAILED DESCRIPTION OF THE PREFERRED EMBODIMENT

Figure 1:
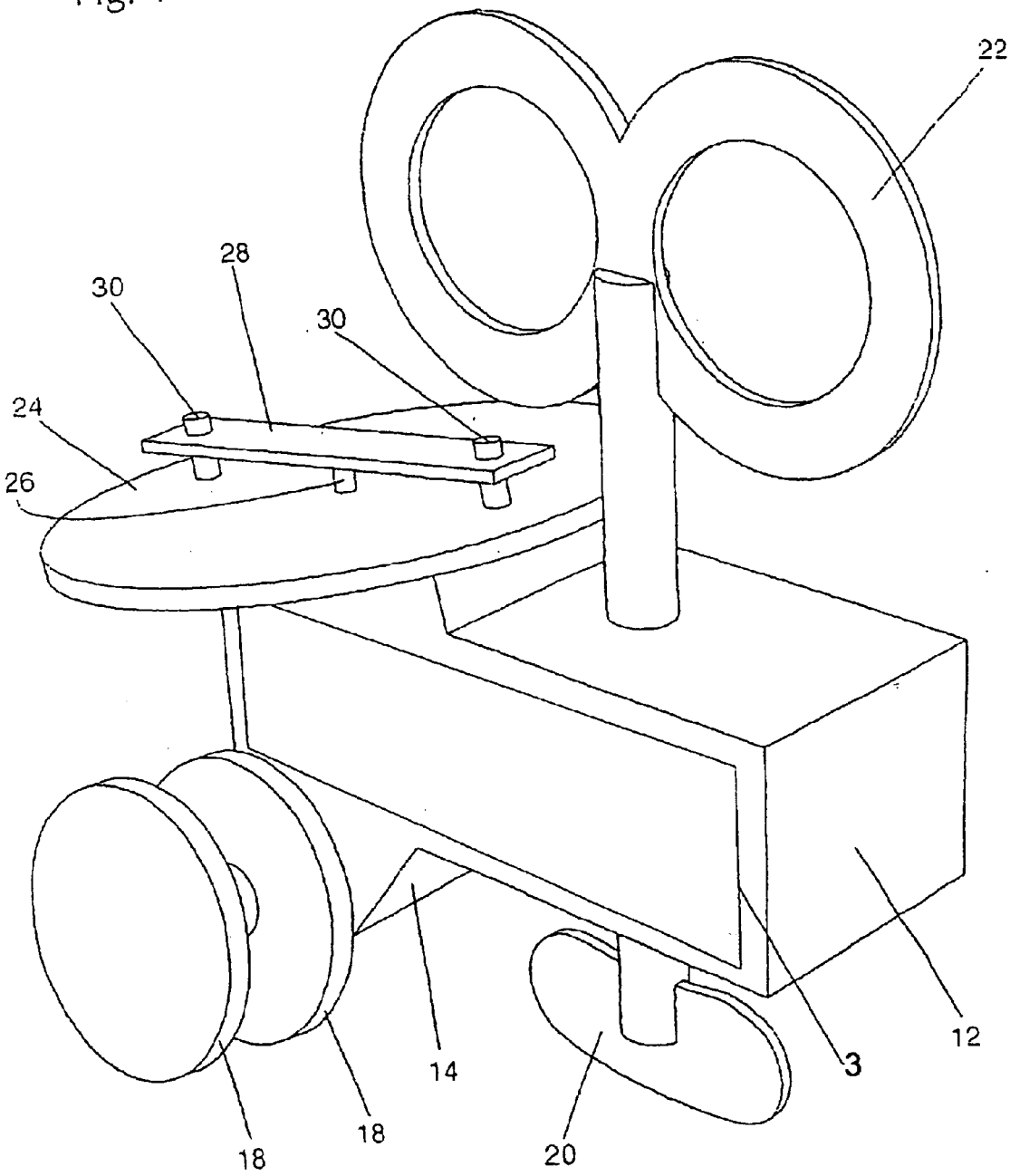
FIG. 1 is a three-quarter perspective view of the amusement device with sparking means, illustrating the principal embodiment thereof.

FIG. 1 is a three-quarter perspective view of the amusement device with sparking means. Illustrated are amusement device with sparking means 10, central housing 12, axle support 14, wheel 18, front support means 20, wind-up handle 22, friction drive member 24, central rotating arm support 26, rotating arm 28, and sparking agent 30.

In general, the amusement device with sparking means 10 comprises a central housing 12 which encapulates a power means 3. In the preferred mode, the power means is a simple gearbox 15 which is engaged by a traditional wind-up mechanism. An axle support 14 is located at a bottom portion of the housing 12, and lies parallel to a flat surface upon which the amusement device sits. Such a flat surface may be a table top or desk, but the device will have the greatest effect when allowed to move upon a larger area such as a floor. The axle support functions 14 to allow an axle 16 to extend horizontally therethrough to allow for such motion.

A plurality of wheels 18 are rigidly affixed to the axle 16. In the preferred mode, two simple lightweight plastic wheels are utilized to accomplish their intended purpose.

Figure 2:
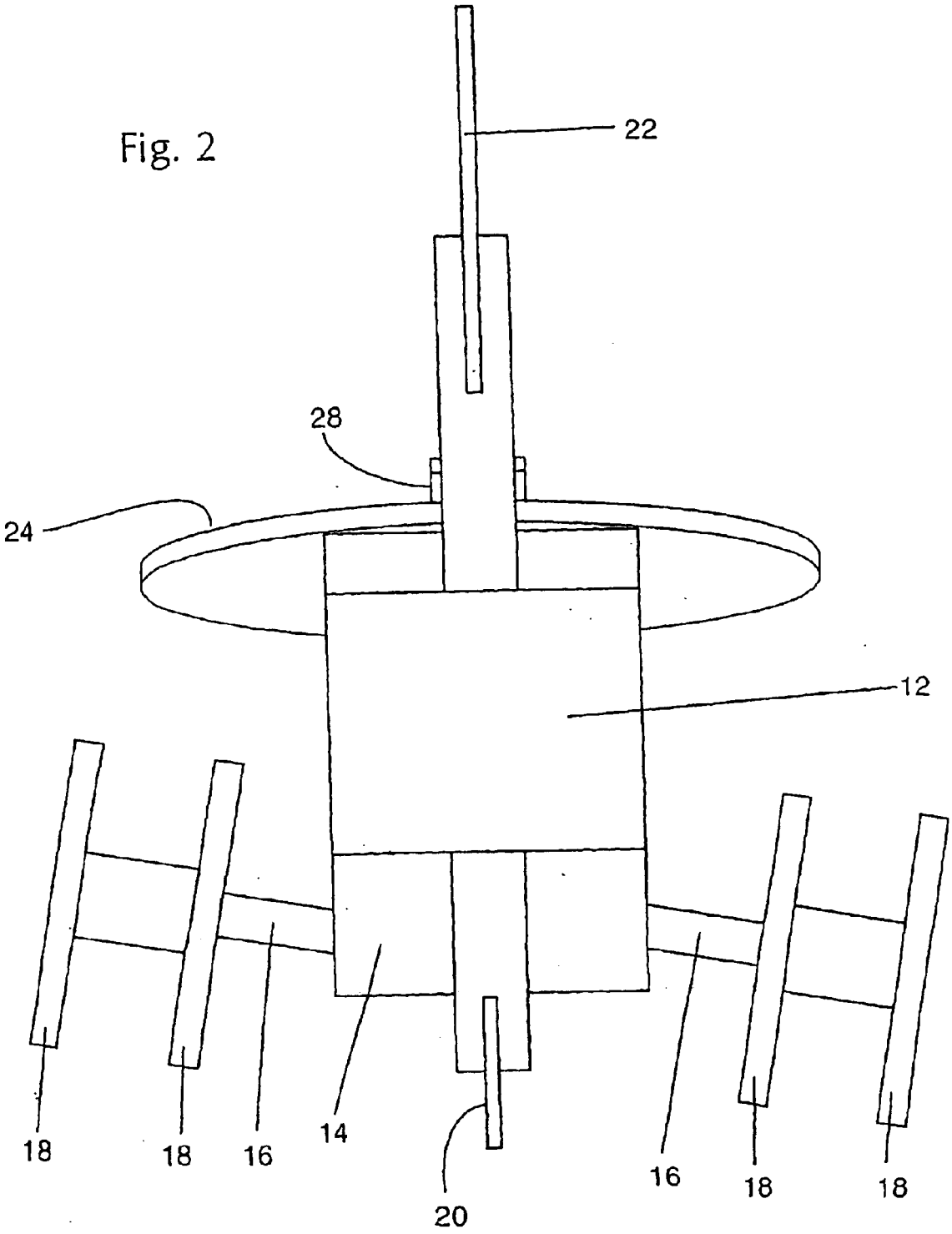
FIG. 2 is a front perspective view of the amusement device with sparking means, showing bent axle for creating motion in a wave-like pattern.

Next, FIG. 2 is a front perspective view of the amusement device with sparking means. Illustrated are central housing 12, axle support 14, axle 18, front support means 20, wind-up handle 22, friction disc member 24, rotating arm 28 and sparking agent 30. Importantly, as shown in this figure, the axle 16 is not straight, but is of a generally bent configuration. This functions to allow the amusement device 10 to move across a surface in a wave-like pattern, rather than in a straightline motion.

Figure 3:
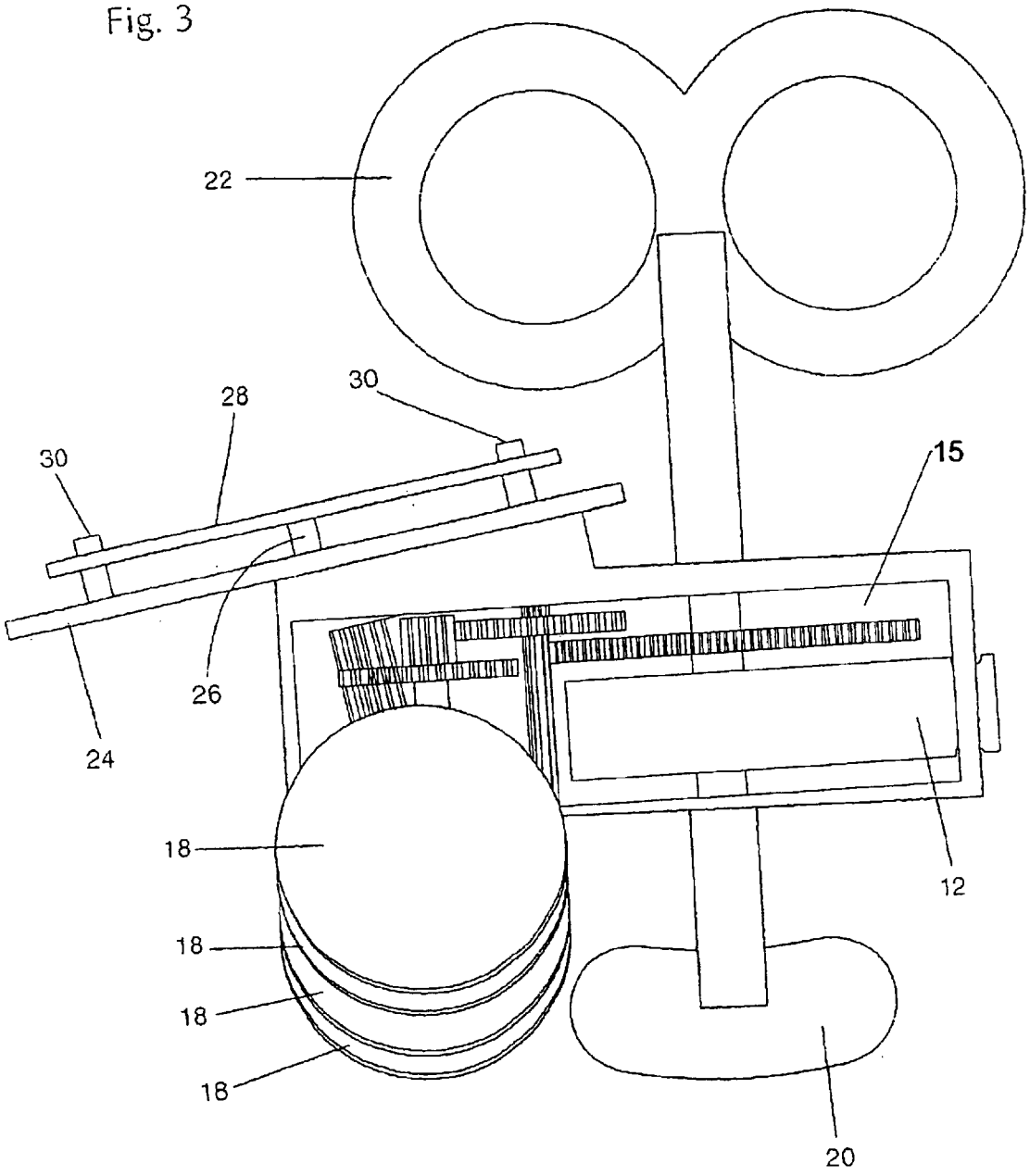
FIG. 3 is a side perspective view of the amusement device with sparking means, illustrating orientation of the wheels to the rudder-like member.

In addition, as shown in FIGS. 2 and 3, which is a side perspective view of the amusement device with sparking means. Illustrated are central housing 12 wheel 18, front support means 20, wind-up handle 22, friction disc member 24, rotating arm 28, sparking agent 30. A rudder member acts as front support means 20 and also comes in contact with the table, desk or other flat surface upon which the 24 amusement device 10 is placed. The rudder member 20 is rigidly affixed to wind-up handle 22 and represents the bottom or lower portion of the wind-up handle. As noted, the wind-up handle 22 is rigidly connected to the power means located within the housing 12, which functions to allow a user to crank the handle to engage the power of the amusement device. When the wind-up handle 22 is released by the user, the handle functions to rotate in the opposite direction of which it was would, thus also rotating the rudder or lower support means 20. Because the rudder 20 comes in direct contact with the surface upon which the device moves, this rotating action, in conjunction with the bent axle, will cause the device to propel generally forward while making a constant series of incremental left and right directional turns.

Figure 4:
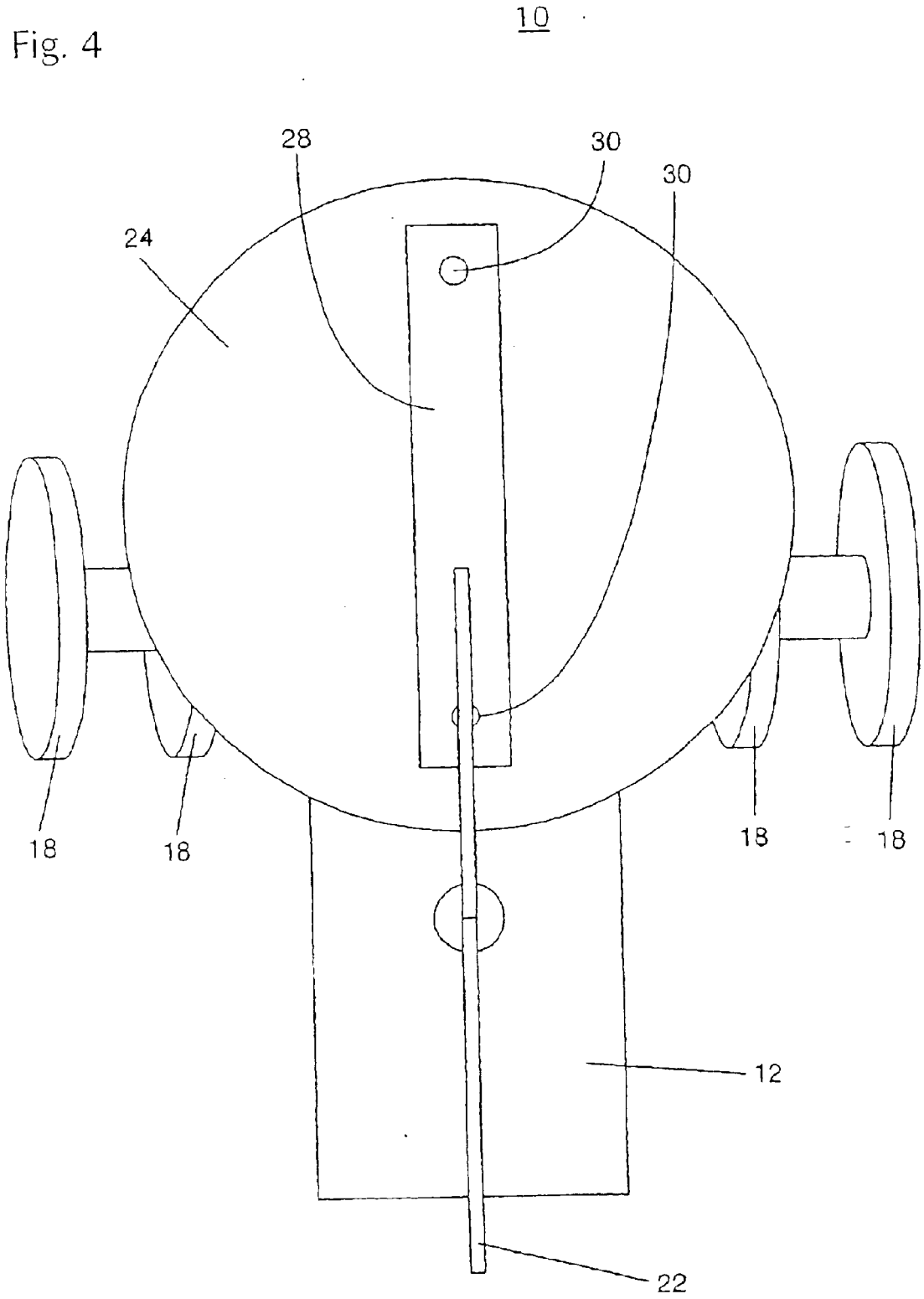
FIG. 4 is a top perspective view of the amusement device with sparking means, 10 illustrating spark creating means.

FIG. 4 is a top perspective view of the amusement device with sparking means. Illustrated are central housing 12, wheel 18, wind-up handle 22, friction disc member 24, rotating arm 28 and sparking agent 30. As shown in this figure, a generally elliptical friction disc member 24 is located at a position above the housing 12 and positioned generally horizontal thereto. The friction disc member 24 comprises a rotating arm 28 which is positioned parallel to the friction disc 24. The rotating arm 28 is secured in place by a central rotating arm support 26. The rotating arm 28 comprises a sparking agent 30 which extends generally downwardly therefrom, towards the friction disc 24. This in turn creates an interesting sparking effect when the amusement device 10 is powered and the disc is rotated.

While the invention has been described as embodied, it is not intended to be limited to the details shown, since it will be understood that various omissions, modifications, substitutions and changes in the forms and details of the device illustrated in its operation cam be made by those skilled in the art without departing in any way from the spirit of the invention.

Without further analysis, the foregoing will so fully reveal the gist of the invention that others can adapt it for various applications without omitting features that, from the standpoint of prior art, constitute essential characteristics of the generic or specific aspects of this invention. What is claimed as new and desired to be protected by Letter Patent is set for in the appended claims.

I claim:

1. An amusement device with sparking means (10) comprising:

a central housing (12)

a power means positioned within said housing;

an axle support (14) located at a bottom portion of the housing (12), the axle support functioning (14) to allow an axle (16) to extend horizontally therethrough;

a plurality of wheels (18) rigidly affixed to the axle (16) and located at extreme ends of the axle (16), the axle (16) of a generally bent configuration, functioning to allow the amusement device (10) to move across a surface in a wave-like pattern;

a rudder member acting as front support means (20) and coming in contact with a flat surface upon which the amusement device (10) is placed, the rudder member (20) rigidly affixed to a wind-up handle (22), wind-up handle (22) rigidly connected to a power means located within the housing (12) functioning to allow a user to crank the handle to engage the power, said rudder being rotated by said power means during device operation so as to cause the device to make a series of incremental left and right turns;

a general friction disc member (24) located at a position above the housing (12) and positioned horizontally thereto, the friction disc member (24) comprising a rotating arm (28) parallel to the friction disc (24), the rotating arm (28) secured in place by a central rotating arm support (26), rotating arm (28) comprising a sparking agent (30) extending downwardly therefrom, the sparking agent (30) functioning to come in contact with rotating friction disc (24) to create a sparking effect when the amusement device (10) is powered.

2. The amusement device with sparking means as described in claim 1, wherein the power means comprises a wind-up gear box comprising a wind-up handle, turning of the wind-up handle rotating a wind-up shaft rigidly affixed thereto to engage the power means.

3. The amusement device with sparking means as described in claim 1, wherein an exterior surface of the housing is generally transparent.

4. The amusement device with sparking means as described in claim 1, wherein the exterior surface of the housing is generally translucent.

5. The amusement device with sparking means as described in claim 1, wherein the housing is constructed of a durable, lightweight plastic.

6. The amusement device with sparking means as described in claim 1, wherein the device further comprises a means to regulate the speed thereof.

* * * * *